United States Patent [19]

Lawson et al.

[11] 4,390,999

[45] Jul. 5, 1983

[54] PANTY HOSE WITH BODY BULGE CONTROL

[75] Inventors: J. William Lawson, Siler City; Robert M. Matthews, Pittsboro, both of N.C.

[73] Assignee: Kellwood Company, St. Louis, Mo.

[21] Appl. No.: 220,380

[22] Filed: Dec. 29, 1980

[51] Int. Cl.[3] ..... A41B 11/04; D04B 9/46; A41B 9/10; D04B 7/12

[52] U.S. Cl. ..... 2/409; 66/172 E; 66/177; 66/190

[58] Field of Search ..... 66/178 A, 177, 190, 66/172 E, 201; 2/409

[56] References Cited

U.S. PATENT DOCUMENTS

| | | | |
|---|---|---|---|
| 1,213,046 | 1/1917 | Werm | 66/190 |
| 2,121,857 | 6/1938 | Carley | 66/172 E |
| 2,169,203 | 8/1939 | Hinchlift | 66/201 |
| 2,188,241 | 1/1940 | Davis | 66/190 |
| 2,192,798 | 3/1940 | Page | 66/190 |
| 3,595,034 | 7/1971 | Safrit | 2/409 |
| 4,019,206 | 4/1977 | Walser | 2/409 |

*Primary Examiner*—Doris L. Troutman

*Attorney, Agent, or Firm*—Bell, Seltzer, Park & Gibson

[57] ABSTRACT

The body bulge controlling portion of the panty hose has elastic yarn incorporated therein to provide a medium amount of compressive force against the body of the wearer and is positioned between portions of the panty hose having a relatively great amount of compressive force and a relatively small amount of compressive force. The compressive force against the body is thereby varied in a stepped or gradual manner so as to eliminate or minimize the abrupt outward bulging of the underlying portion of the body of the wearer. In one embodiment of the panty hose, the body bulge controlling portion is positioned between a panty girdle portion with a great amount of compressive force and the sheer legs which include very little if any compressive force. In another embodiment, the bulge controlling portion is positioned between the elastic waistband and the upper portion of the panty of the panty hose.

7 Claims, 8 Drawing Figures

PANTY HOSE WITH BODY BULGE CONTROL

FIELD OF THE INVENTION

This invention relates generally to a panty hose type garment and more particularly to such a garment including a body bulge controlling portion with elastic yarn incorporated therein to provide a medium amount of compressive force against the body of the wearer. The body bulge controlling portion is positioned between portions of the panty hose having a relatively great amount of compressive force and a relatively small amount of compressive force so that the compressive force against the body is varied in a stepped or gradual manner.

BACKGROUND OF THE INVENTION

The conventional type of panty hose garment usually includes a pair of legs knit solely of sheer stretchable yarn and providing sufficient stretchability to fit a range of leg sizes while providing a relatively small amount of compressive force against the underlying legs of the wearer. Some types of panty hose, the so-called "panty girdle" type, include a panty girdle formed of a heavy elastic fabric with the upper ends of sheer hosiery legs being sewn to the leg openings in the panty girdle. This type of panty girdle applies a great amount of compressive force against the underlying portion of the body of the wearer while the portions of the sheer stockings immediately adjacent to the leg openings apply very little, if any, compressive force against the upper thigh portions of the legs of the wearer. This immediate transition from high compressive force by the panty girdle to little or no compressive force by the adjacent hosiery leg causes an abrupt outward bulging of the portions of the upper thighs below the leg openings of the panty girdle portion and these bulge lines are visible when the panty hose is worn beneath tight-fitting slacks or skirts.

Other panty hose of the so-called "control top" type are formed by incorporating a heavy elastic or spandex yarn in the upper portions of elongated stocking blanks while the lower leg portions of the stocking blanks are knit of a relatively sheer and stretchable yarn. The upper ends of the elongated stocking blanks are then slit longitudinally and the slit edges of a pair of the blanks are seamed together so that the upper end portions of the blanks form the control top panty and the sheer legs extend upwardly to the upper thighs of the wearer. The control top panty portion provides a relatively great amount of compressive force against the body of the wearer while the immediately adjacent sheer leg portions provide little, if any, compressive force against the upper thighs. This immediate transition from high compressive force by the control top panty to little or no compressive force by the adjacent hosiery leg causes an abrupt outward bulging of the portions of the upper thighs below the juncture of the control top panty with the legs. These bulge lines extend around the lower portion of the control top panty and are visible when the panty hose is worn beneath tight-fitting slacks or skirts.

In the formation of what is known as "all sheer" panty hose, the sewn together elongated hosiery blanks are knit throughout their entire length of sheer, stretchable yarn so that the same small amount of compressive force is applied against both the lower body and legs of the wearer and no bulge lines are formed around the upper thighs. However, this all sheer type panty hose is provided with either a sewn-on elastic waistband or with an integrally knit waistband which includes a substantial amount of elastic or spandex yarn to provide a relatively great amount of compressive force around the waist of the wearer. This immediate transition from high compressive force by the elastic waistband to little or no compressive force by the adjacent panty causes an abrupt outward bulging of the portion of the body directly under the waistband to produce an objectionable bulge line.

SUMMARY OF THE INVENTION

With the foregoing in mind, it is an object of the present invention to provide a body bulge controlling intermediate portion in a panty hose garment of the type wherein certain portions include elastic or spandex yarn in an amount sufficient to provide a relatively great amount of compressive force against the underlying portion of the body of the wearer and other portions, normally positioned adjacent the certain portions, knit solely of stretchable yarn to provide a relatively small amount of compressive force against the underlying portion of the body of the wearer. The body bulge controlling intermediate portion is positioned between and interconnects the certain and other portions and has a sufficient amount of elastic or spandex yarn incorporated therein to provide a medium amount of compressive force against the underlying portion of the body of the wearer to prevent an abrupt outward bulging of the body of the wearer. The provision of the bulge controlling intermediate portion provides a gradually varying or stepped amount of compressive force to be applied over a substantial area of the body to reduce and minimize the visible bulge line normally present adjacent the juncture of the portions of the panty hose including relatively great and relatively small amounts of compressive force.

When utilized in a panty girdle type panty hose, the present body bulge controlling intermediate portion is positioned between the leg openings of the panty girdle and the sheer portions at the upper thighs of the legs. When utilized in a control top type panty hose, the body bulge controlling intermediate portion is positioned between the panty portion of the elongated hosiery blank and the upper ends of the sheer legs. When utilized in an all sheer type panty hose, the body bulge controlling intermediate portion is positioned immediately below the highly compressive waistband and interconnects the waistband and the upper portion of the sheer panty portion.

In accordance with the present invention, the body bulge controlling intermediate portion is knit of stretchable yarn with elastic or spandex yarn incorporated in spaced-apart courses to provide a medium amount of compressive force against the corresponding portion of the body. The body bulge controlling intermediate portion also includes first and second sections in which the spacing of the elastic yarns is varied so that the compressive force in one section of the intermediate portion is slightly greater than the compressive force in the adjacent section to provide a further stepping or graduation of the compressive force against the underlying portion of the body. For example, the elastic yarn may be incorporated in every other course in the first section of the intermediate portion while the elastic yarn is incorporated in every fourth course in the second section so that the compressive force of the second section is slightly less than the compressive force in the first section. Each section is about one to one and one-half inches wide so that the intermediate portion covers an area of about two to three inches and covers a substantial area of the underlying portion of the body of the wearer.

BRIEF DESCRIPTION OF THE DRAWINGS

Other objects and advantages will appear as the description proceeds when taken in connection with the accompanying drawings, in which.

DESCRIPTION OF THE EMBODIMENT ILLUSTRATED IN FIGS. 1 AND 2

Figure 1:
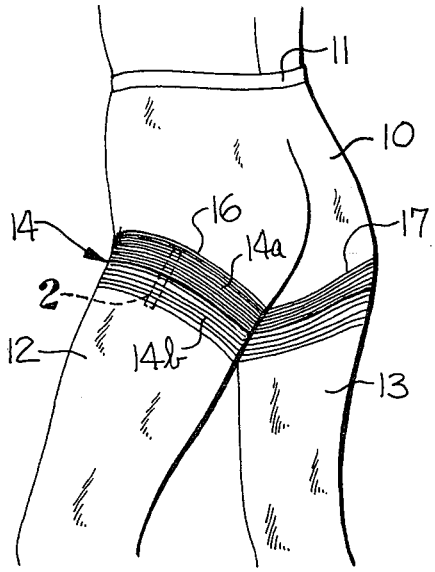
FIG. 1 is a rear perspective view of the upper portion of one embodiment of the panty hose of the present invention and illustrating the same as it appears when worn.

The panty hose illustrated in FIG. 1 is of the type generally known as a panty girdle type panty hose including a panty girdle 10 which is usually formed of a heavy elastic fabric including elastic yarn in an amount sufficient to provide a relatively great amount of compressive force against the underlying body portion of the wearer. The panty girdle portion 10 may be knit with a body yarn and with elastic or spandex yarn in every course and the fabric may be knit either flat or circular and suitably cut and sewn to form the panty girdle 10. An elastic waistband 11 is usually attached to the upper waist opening.

It is the usual practice to directly sew the upper end of a pair of relatively sheer knit hosiery legs 12, 13 directly to the leg openings of the panty girdle 10 and the upper end portions of the legs are normally knit solely of stretchable yarn to provide a relatively small amount of compressive force against the legs of the wearer. The stretchable yarn is used in the sheer legs 12, 13 to provide a sufficient degree of stretchability that the legs will fit a wide range of leg sizes. When this conventional type of panty hose is worn, particularly by a lady having fat or relatively heavy lower body and upper thighs, the relatively great amount of compressive force against the lower body causes the body to be constricted in those areas covered by the panty girdle 10. Since the immediately adjacent sheer leg portion applies only a relatively small amount of compressive force against the upper thigh portions of the legs of the wearer, the upper thigh portions adjacent the leg openings of the panty girdle abruptly bulge outwardly and form unsightly bulge lines which are visible when the panty hose is worn beneath tight-fitting slacks and skirts or the like.

In accordance with the present invention, the upper end portions of the sheer stretchable legs, 12, 13 are each provided with a body bulge controlling intermediate portion, broadly indicated at 14, in which elastic or spandex yarn is incorporated in spaced-apart courses to provide a medium amount of compressive force against the corresponding portions of the upper thighs of the body of the wearer. Thus the amount of compressive force is gradually reduced or stepped from the high compression applied by the panty girdle 10 to the low compression applied by the sheer legs 12, 13 and to thereby prevent an abrupt outward bulging of the corresponding portion of the body of the wearer.

The upper ends of the legs 12, 13 are sewn to the leg openings of the panty girdle 10 by corresponding seam lines 16, 17, in the usual manner. The intermediate portion 14 is preferably provided with an upper or first section, indicated at **14*a*, and extending from the seam line 16 downwardly to the dash-dot line 18 in FIG. 2. This upper or first section 14*a* includes elastic yarn E (striped for identification) incorporated in every other course. The elastic yarn E is illustrated as being knit in every other course in FIG. 2** and alternating with courses of body yarn B. However, it is to be understood that the elastic yarn E can be incorporated in spaced-apart courses by other well-known methods, such as being inlaid.

Figure 2:
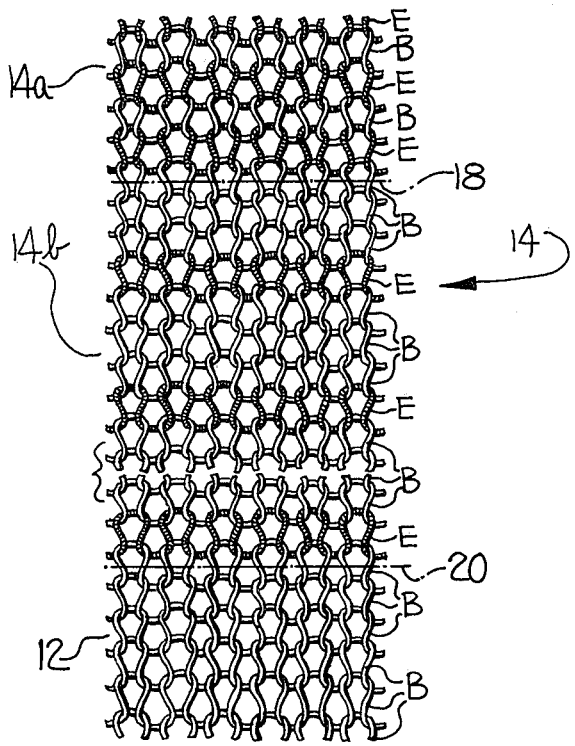
FIG. 2 is a greatly enlarged fragmentary elevational view taken substantially in the rectangular dotted line area indicated at 2 in FIG. 1.

The intermediate portion 14 also includes a second or lower section **14*b* extending from the dash-dot line 18 to the dash-dot line 20 in FIG. 2. The elastic yarn E is also incorporated in spaced-apart courses of the lower section 14*b*, and is illustrated as being incorporated in every fourth course with the three intervening courses being knit of the body yarn B. The full extent or length of the sections 14*a* and 14*b*, comprising the body bulge controlling intermediate portion 14, are not illustrated in FIG. 2 but each of these sections 14*a* and 14*b* are preferably about one to one and one-half inches in length so that the gradually stepped or reducing amount of compressive force provided by the intermediate portion 14** is spread over a total distance of approximately two to three inches of the upper thigh of the leg of the wearer.

The remainder of the leg 12, below the dash-dot line 20 in FIG. 2 is knit with the body yarn B only, which is preferably a stretchable synthetic yarn having sufficient sheerness and stretchable characteristics to provide a comfortable fit over a wide range of leg sizes. If desired, the upper ends of the legs 12, 13 may be provided with small turned welts to facilitate the seaming of the upper ends of the legs to the leg openings in the panty girdle 10.

DESCRIPTION OF THE EMBODIMENT ILLUSTRATED IN FIGS. 3–5

Figure 5:
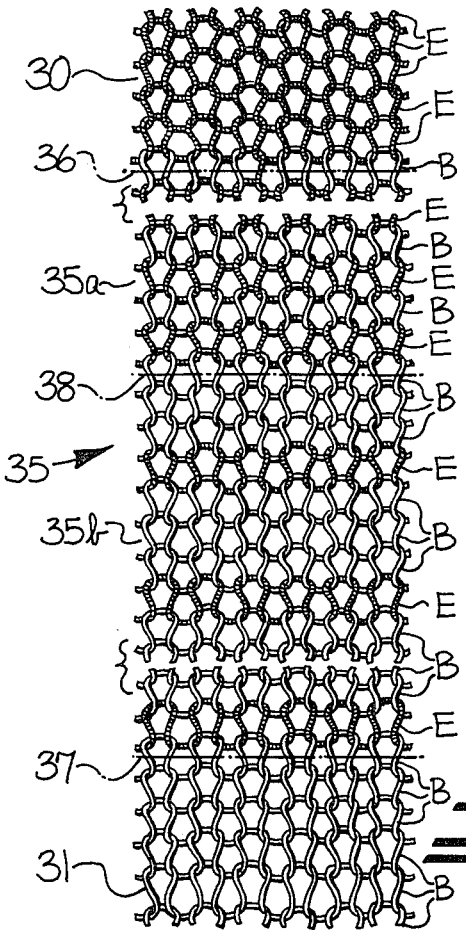
FIG. 5 is a greatly enlarged fragmentary elevational view of the area of the fabric enclosed by the dotted line rectangle 5 in FIG. 4.
Figure 4:
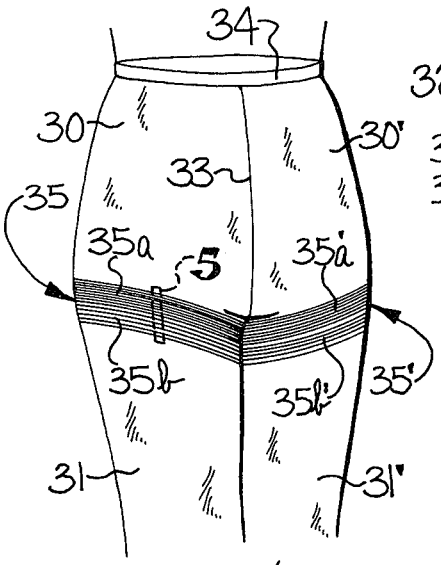
FIG. 4 is a front perspective view of a second embodiment of the panty hose of the present invention and illustrating the same as it appears when worn.
Figure 3:
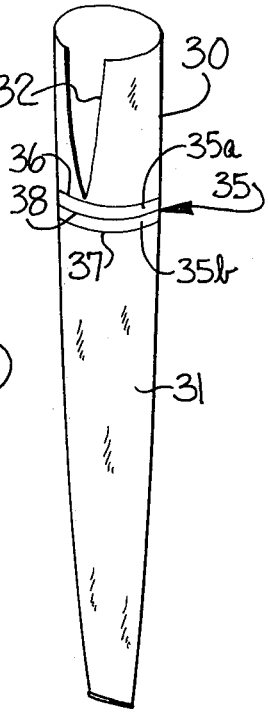
FIG. 3 is a perspective elevational view of an elongate hosiery blank of the type utilized in forming another embodiment of the panty hose of the present invention.

The control top type panty hose illustrated in FIGS. 3–5 is formed from a pair of elongated hosiery blanks of the type illustrated in FIG. 3, including an upper panty portion 30 and a lower sheer stretchable leg 31. To form the control top panty hose shown in FIG. 4, each of the elongate hosiery blanks is slit longitudinally, as indicated at 32 in FIG. 3, and the corresponding slit edges are sewn together with a substantially U-shaped seam 33 (FIG. 4) and a suitable elastic waistband 34 is sewn to the upper waist opening. The upper ends of the corresponding legs 31, 31' are thus integrally formed with the lower portion of the corresponding panty portions 30, 30' and the body bulge controlling intermediate portion, broadly indicated at 35 (extending between the dash-dot lines 36 and 37 of FIG. 5), is positioned between the panty portion 30, containing a relatively great amount of compressive force, and the sheer leg 31, providing a relatively small amount of compressive force.

In the present instance, the panty portion 30 is illustrated in FIG. 5 as being knit with elastic yarn E in every course (above the dash-dot line 36) while the elastic yarn E is knit in spaced-apart courses in the intermediate portion 35 and the leg 31 (below the dash-dot line 37) is knit entirely of the stretchable body yarn B. The body bulge controlling intermediate portion 35 is preferably knit with an upper or first section **35*a* in which the elastic yarn E is knit in every other course (between dash-dot lines 36 and 38) and a lower or second section 35*b* in which the spandex yarn is knit in every fourth course (between dash-dot lines 38 and 37**).

Thus, in the control top type panty hose the panty portion 30 includes elastic yarn in an amount sufficient to provide a relatively great amount of compressive force against the underlying portion of the body of the wearer while the sheer leg portion 31 is knit solely of stretchable body yarn B to provide a relatively small amount of compressive force against the legs and upper thighs of the wearer. The body bulge control intermediate portion 35 is positioned between the panty portion 30 and the sheer leg portion 31 and has the elastic yarn incorporated in spaced-apart courses to provide a medium amount of compressive force against the corresponding portion of the body so that a gradually reducing or stepped amount of compressive force is applied against the upper thighs of the legs of the wearer and prevents an abrupt outward bulging of the corresponding portion of the body to eliminate or drastically reduce the outwardly bulging lines which normally occur at the juncture of the panty and leg portion of the panty hose. Portions of the upper and lower sections **35*a*, 35*b* are broken away in FIG. 5 and it is understood that these two sections are of substantially the same length and each are approximately one and one-quarter inches in length so that the body bulge controlling intermediate portion 35** normally covers an area of approximately two and one-half inches in length at the upper thighs of the legs.

DESCRIPTION OF THE EMBODIMENT ILLUSTRATED IN FIGS. 6–8

Figure 6:
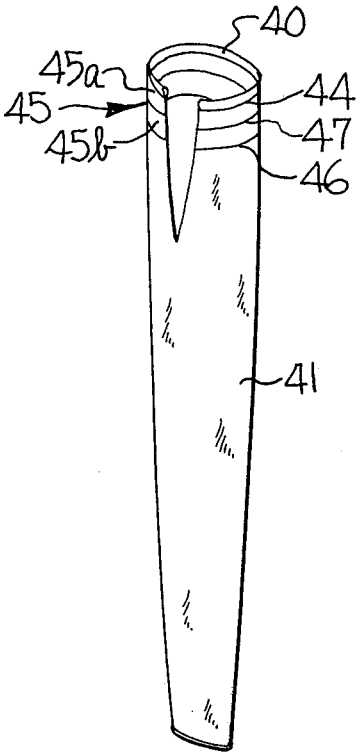
FIG. 6 is a perspective elevational view of an elongate hosiery blank used in forming a third embodiment of the panty hose of the present invention.
Figure 7:
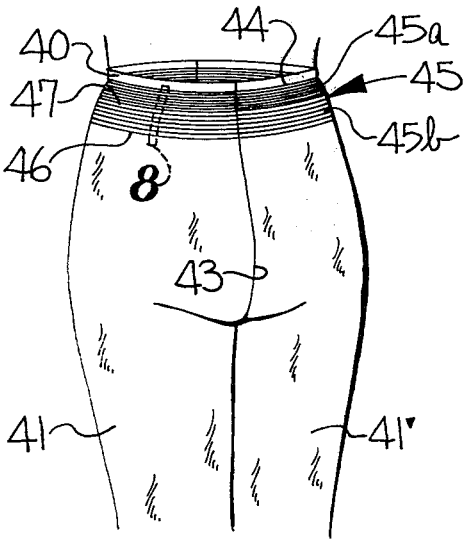
FIG. 7 is a front perspective view of a third embodiment of the panty hose of the present invention and illustrating the same as it appears when worn.
Figure 8:
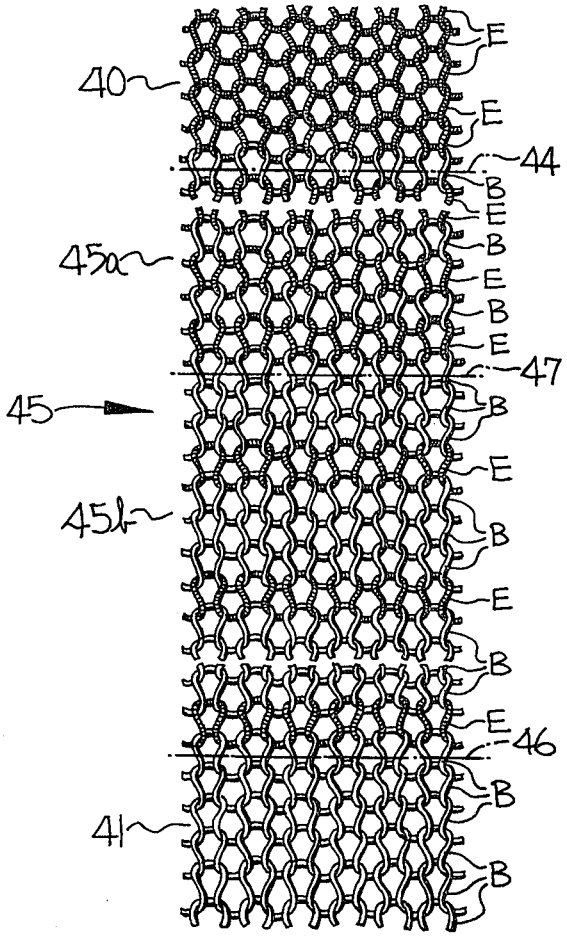
FIG. 8 is a greatly enlarged fragmentary elevational view of the area of the fabric enclosed in the dotted line rectangle 8 in FIG. 7.

The all sheer type of panty hose garment illustrated in FIGS. 6–8 is formed of two elongated hosiery blanks of the type illustrated in FIG. 6 and including a sheer leg portion 41 extending substantially to the upper end of the blank and including an integrally knit turned welt type waistband 40. The hosiery blank is longitudinally slit, as indicated at 42 in FIG. 6, and the corresponding edges of the slits of a pair of the hosiery blanks are seamed along a substantially U-shaped seam line 43 (FIG. 7) to form a sheer panty portion with integrally knit depending legs 41, 41'. The turned welt type waistband 40 includes elastic yarn E (FIG. 8) in an amount sufficient to provide a relatively great amount of compressive force around the waist of the wearer.

A portion of the waistband 40 is illustrated above the dash-dot line 44 in FIG. 8 with the elastic yarn E being knit in every course. A body bulge controlling intermediate portion, broadly indicated at 45, is provided between the waistband 40 and the upper end of each sheer panty and the respective legs 41, 41' and extends between the dash-dot lines 44 and 46 in FIG. 8. The intermediate portion 45 is preferably divided into an upper or first section **45*a* and a lower or second section 45*b*. The upper section 45*a* includes elastic yarn E knit in every other course, down to the dash-dot line 47, and the lower section 45*b* includes elastic yarn E knit in every fourth course, down to the dash-dot line 46**. If desired, the waist opening may be provided with a sewn-on elastic web or tape, in place of the turned welt type waistband.

With the body bulge controlling intermediate portion 45 positioned between the highly compressive waistband 40 and the upper end of the sheer panty portion having very little compression, successive great, medium, and small amounts of compressive forces are applied to thereby provide a gradually or stepped reducing amount of compressive force against the underlying portion of the body. The presence of the intermediate portion 45 prevents an abrupt outward bulging of the body of the wearer, as would be the case if the sheer panty portion were connected directly to the highly compressive waistband.

Thus, in each embodiment of the invention, certain portions of the panty hose garment include elastic yarn in an amount sufficient to provide a relatively great amount of compressive force against the underlying portion of the body of the wearer and other portions (normally positioned adjacent the certain portions) are knit solely of stretchable yarn to provide a relatively small amount of compressive force against the underlying portion of the body. In accordance with the present invention, a body bulge controlling intermediate portion is positioned between and interconnects the certain and other portions and the intermediate portion is knit of stretchable yarn with elastic yarn incorporated in spaced-apart courses to provide a medium amount of compressive force against the corresponding portion of the body. Thus, successive great, medium and small amounts of compressive force are applied in a gradual or stepped manner against the underlying portion of the body to prevent or drastically reduce the abrupt outward bulging of the corresponding portion of the body of the wearer.

Although the relatively great amount of compressive force has been described as being provided by including the elastic yarn in every course in certain portions of the panty hose, it is to be understood that the relatively great amount of compressive force can be attained by incorporating a relatively heavy elastic or spandex yarn in spaced-apart courses of those certain portions of the panty hose. In this case, the body bulge controlling intermediate portion may be knit by incorporating a smaller size of spandex or elastic yarn in spaced-apart courses and/or incorporating the elastic yarn in courses which are spaced further apart in the intermediate portion than the adjacent portion with a relatively great amount of compressive force. Also the body bulge controlling intermediate portion may have the elastic yarn incorporated in the same spaced-apart courses throughout the length thereof or the spacing may vary to provide a stepped amount of compressive force in the intermediate portion.

In the drawings and specification there has been set forth the best mode presently contemplated for the practice of the invention, and although specific terms are employed, they are used in a generic and descriptive sense only and not for purposes of limitation, the scope of the invention being defined in the claims.

That which is claimed is:

1. In a panty hose type garment including certain portions with elastic yarn in an amount sufficient to provide a relatively great amount of compressive force against the underlying portion of the body of the wearer, and other portions normally joined directly to said certain portions and being knit solely of stretchable yarn to provide a relatively small amount of compressive force against the underlying portion of the body of the wearer, the combination therewith of a body bulge controlling intermediate portion positioned between and interconnecting said certain and said other portions, said intermediate portion being knit of stretchable yarn with elastic yarn incorporated in spaced-apart courses and providing a lesser amount of elastic yarn in said intermediate portion than the amount of elastic yarn provided in said certain portions to provide a medium amount of compressive force against the portion of the body of the wearer underlying said intermediate portion, said successive great, medium, and small amounts of compressive forces applied by said corresponding certain, intermediate, and other portions of said garment thereby applying a gradually varying amount of compressive force against the underlying portion of the body to prevent an abrupt outward bulging of the corresponding portion of the body of the wearer.

2. A panty hose type garment according to claim 1 wherein said certain portions comprise a panty portion, wherein said other portions comprise the lower portions of a pair of legs sewn at their upper ends to said panty portion, and wherein said intermediate portion comprises the upper portions of said legs positioned adjacent the sewn connection with said panty portion.

3. A panty hose type garment according to claim 2 wherein said elastic yarn is incorporated in every course of said panty portion, and wherein said upper portion of said legs each comprise first and second sections, said first section being positioned between said panty portion and said second section and including elastic yarn incorporated in every other course, and said second section being positioned between said first section and said leg and including elastic yarn incorporated in every fourth course.

4. A panty hose type garment according to claim 1 wherein said certain portions comprise a panty portion formed of the upper portions of a pair of longitudinally slit and seamed together elongated stocking blanks, wherein said other portions comprise the lower portions of a pair of depending legs integrally knit with said panty portion, and wherein said intermediate portion comprises the upper portions of said legs positioned adjacent said panty portion.

5. A panty hose type garment according to claim 4 wherein said elastic yarn is incorporated in every course of said panty portion, and wherein said elastic yarn is incorporated in every other course throughout at least a portion of said intermediate portion.

6. A panty hose type garment according to claim 1 including a panty portion with an upper waist opening, a waistband surrounding said waist opening, and a pair of legs depending from said panty portion, wherein said waistband comprises said certain portions, and wherein said intermediate portion comprises the upper portion of said panty portion positioned adjacent said waistband.

7. A panty hose type garment according to claim 6 wherein said elastic yarn is incorporated in every course of said waistband, and wherein said elastic yarn is incorporated in every other course throughout at least a portion of said intermediate portion.

* * * * *